US008949003B2

(12) United States Patent
Okada

(10) Patent No.: US 8,949,003 B2
(45) Date of Patent: Feb. 3, 2015

(54) CONTROL APPARATUS FOR INTERNAL COMBUSTION ENGINE

(75) Inventor: Yoshihiro Okada, Susono (JP)

(73) Assignee: Toyota Jidosha Kabushiki Kaisha, Aichi-ken (JP)

( * ) Notice: Subject to any disclaimer, the term of this patent is extended or adjusted under 35 U.S.C. 154(b) by 0 days.

(21) Appl. No.: 13/978,664

(22) PCT Filed: Feb. 18, 2011

(86) PCT No.: PCT/JP2011/053527

§ 371 (c)(1),
(2), (4) Date: Jul. 8, 2013

(87) PCT Pub. No.: WO2012/111145

PCT Pub. Date: Aug. 23, 2012

(65) Prior Publication Data

US 2013/0333662 A1 Dec. 19, 2013

(51) Int. Cl.

| | |
|---|---|
| ***F02D 41/22*** | (2006.01) |
| ***F02D 45/00*** | (2006.01) |
| ***F02D 35/02*** | (2006.01) |
| ***F02D 41/04*** | (2006.01) |
| *F02D 41/14* | (2006.01) |

(52) U.S. Cl.

CPC ..... *F02D 45/00* (2013.01); *F02D 35/02* (2013.01); *F02D 41/047* (2013.01); *F02D 2250/26* (2013.01); *F02D 2041/1412* (2013.01); *F02D 2250/11* (2013.01)

USPC ..... 701/107; 123/436; 123/479

(58) Field of Classification Search

CPC ..... F02D 41/047; F02D 2250/11; F02D 2250/26; F02D 41/1495; F02D 41/22

USPC ..... 701/103, 107, 110, 111; 123/435, 436, 123/479, 198 D

See application file for complete search history.

(56) References Cited

U.S. PATENT DOCUMENTS

2003/0010324 A1 1/2003 Joos et al.

FOREIGN PATENT DOCUMENTS

| | | | |
|---|---|---|---|
| EP | 1 132 598 | A1 | 9/2001 |
| JP | 11-324775 | A | 11/1999 |
| JP | 2001-193534 | A | 7/2001 |
| JP | 2002-357174 | A | 12/2002 |
| JP | 2007-224862 | A | 9/2007 |
| JP | 2007-232007 | A | 9/2007 |
| JP | 2009-133284 | A | 6/2009 |
| JP | 2010133367 | A | 6/2010 |
| WO | 02/144669 | A1 | 2/2002 |

OTHER PUBLICATIONS

International Search Report for PCT/JP2011/053527, dated for Apr. 5, 2011.

*Primary Examiner* — Hai Huynh
(74) *Attorney, Agent, or Firm* — Sughrue Mion, PLLC

(57) ABSTRACT

Provided is a control apparatus for an internal combustion engine, which can favorably suppress an occurrence of abnormal combustion regardless of its operational conditions. An occurrence probability of abnormal combustion of the internal combustion engine (10) is obtained on the basis of a fuel dilution index. An expected value I of the number of occurrences of abnormal combustion per a predetermined time period is calculated on the basis of the occurrence probability of abnormal combustion. The upper limit value of a torque generated by the internal combustion engine (10) is limited low so that the expected value I does not exceed a predetermined tolerable value.

9 Claims, 5 Drawing Sheets

*1:Cooling water temperature

CONTROL APPARATUS FOR INTERNAL COMBUSTION ENGINE

CROSS REFERENCE TO RELATED APPLICATIONS

This application is a National Stage of International Application No. PCT/JP2011/053527 filed Feb. 18, 2011, the contents of all of which are incorporated herein by reference in their entirety.

TECHNICAL FIELD

The present invention relates to a control apparatus for an internal combustion engine, and more particular to a control apparatus for an internal combustion engine that is suitable for preventing abnormal combustion such as pre-ignition.

BACKGROUND ART

So far, for example, Patent Document 1 discloses a combustion diagnosis method of an internal combustion engine that allows the difference between pre-ignition and abnormality of an in-cylinder pressure sensor to be distinctly discerned and determined by use of the in-cylinder pressure sensor. The conventional combustion diagnosis method determines that pre-ignition has occurred when the standard deviation of a change in an in-cylinder pressure at a predetermined crank angle before ignition is equal to or larger than a threshold value of the standard deviation and a load factor in-cylinder pressure difference that is obtained by dividing a pressure difference of the in-cylinder pressure between a reference crank angle and the top dead center by a load factor on the driven side is equal to or larger than a threshold value of the load factor in-cylinder pressure difference.

Including the above described document, the applicant is aware of the following documents as related art of the present invention.

CITATION LIST

Patent Documents

Patent Document 1: Japanese Laid-open Patent Application Publication No. 2009-133284

Patent Document 2: Japanese Laid-open Patent Application Publication No. 2007-224862

Patent Document 3: Japanese Laid-open Patent Application Publication No. 11-324775

SUMMARY OF INVENTION

Technical Problem

The probability of occurrence of abnormal combustion such as pre-ignition described above changes in accordance with an operational condition of an internal combustion engine. Therefore, a control of the internal combustion engine is needed that allows an occurrence of abnormal combustion to be favorably suppressed regardless of its operational conditions.

The present invention has been made to solve the problem as described above, and has its object to provide a control apparatus for an internal combustion engine, which can favorably suppress an occurrence of abnormal combustion regardless of its operational conditions.

Solution to Problem

A first aspect of the present invention is a control apparatus for an internal combustion engine, comprising:

abnormal combustion probability obtaining means for obtaining an occurrence probability of abnormal combustion of the internal combustion engine;

expected-value calculation means for calculating an expected value of the number of occurrences of the abnormal combustion per a predetermined time period, based on the occurrence probability of the abnormal combustion that is obtained by the abnormal combustion probability obtaining means; and torque limit means for causing an upper limit value of a torque generated by the internal combustion engine to be lowered so that the expected value that is calculated by the expected-value calculation means does not exceed a predetermined tolerable value.

A second aspect of the present invention is the control apparatus for an internal combustion engine according to the first aspect of the present invention, wherein the torque limit means causes the upper limit value of the torque to be lowered more, as the expected value that is calculated by the expected-value calculation means becomes larger toward the tolerable value.

A third aspect of the present invention is the control apparatus for an internal combustion engine according to the second aspect of the present invention, wherein the torque limit means causes the upper limit value of the torque to be lowered more, as a value which is at a point of division of the tolerable value and which the expected value that is calculated by the expected-value calculation means exceeds increases.

A fourth aspect of the present invention is a control apparatus for an internal combustion engine, comprising:

abnormal combustion probability obtaining means for obtaining an occurrence probability of abnormal combustion of the internal combustion engine in relation to an operational region of the internal combustion engine; and torque limit means for causing an upper limit value of a torque generated by the internal combustion engine to be lowered so that a maximum probability point at which the occurrence probability reaches its maximum in the operational region moves to a position at which the occurrence probability becomes smaller or equal to a predetermined tolerable value.

A fifth aspect of the present invention is the control apparatus for an internal combustion engine according to the fourth aspect of the present invention, wherein when the occurrence probability at the maximum probability point is higher than the expected value, the torque limit means causes the upper limit value of the torque to be lowered so that, on an equivalent output line of the internal combustion engine, the maximum probability point moves to a position at which the occurrence probability becomes equal to or lower than the expected value.

A sixth aspect of the present invention is the control apparatus for an internal combustion engine according to the fourth aspect of the present invention, wherein when the occurrence probability at the maximum probability point is higher than the expected value, the torque limit means causes the upper limit value of the torque to be lowered so that a torque curve, in which the occurrence probability equivalent to that of a maximum torque curve in a tolerable state in which the occurrence probability is at a tolerable level is obtained on the equivalent output line, becomes an upper limit torque curve.

A seventh aspect of the present invention is the control apparatus for an internal combustion engine according to any one of the first to sixth aspects of the present invention, wherein the abnormal combustion probability obtaining means includes fuel dilution index obtaining means for obtaining a fuel dilution index that represents a degree of fuel dilution of oil attached to a wall surface in a cylinder of the internal combustion engine, and is means for obtaining the occurrence probability based on the fuel dilution index obtained by the fuel dilution index obtaining means.

Advantageous Effects of Invention

According to the first aspect of the present invention, the upper limit value of the torque generated by the internal combustion engine is limited to be low so that the expected value of the number of occurrences of abnormal combustion per the predetermined time period does not exceed the predetermined tolerable value. As a result of this, an occurrence of abnormal combustion can be successfully suppressed regardless of the operational conditions. In addition, the present invention determines whether or not to perform the limit of the upper limit value of the torque depending on a change in the expected value. Therefore, an occurrence of abnormal combustion can be suppressed, while the limit of a usable operational region is avoided from being provided as possible by limiting the upper limit value of the torque, within a range in which the expected value does not exceed the tolerable value.

According to the second aspect of the present invention, an occurrence of abnormal combustion can be favorably suppressed, while the limit of a usable operational region is avoided from being provided as possible by limiting the upper limit value of the torque.

Third aspect of the present invention can provide a concrete method for causing the upper limit value of the torque to be lowed as the expected value becomes larger toward the tolerable value.

According to the fourth aspect of the present invention, the upper limit value of the torque generated by the internal combustion engine is limited to be low so that the maximum probability point at which the occurrence probability of abnormal combustion reaches its maximum in the operational region moves to a position at which the occurrence probability becomes smaller or equal to the predetermined tolerable value. As a result of this, the use of the operational region on the higher load side, such as an operational region in which the occurrence probability exceeds the expected value, is limited. Therefore, an occurrence of abnormal combustion can be successfully suppressed regardless of the operational conditions.

According to the fifth and sixth aspects of the present invention, when the occurrence probability of the maximum probability point is higher than the expected value, the occurrence probability of abnormal combustion can be decreased to the same level as that in a tolerable state in which the occurrence probability is at a tolerable level, with the internal combustion engine being able to produce the equivalent output power.

According to the seventh aspect of the present invention, the occurrence probability of abnormal combustion can be favorably obtained on the basis of the fuel dilution index that represents a degree of fuel dilution of oil attached to the wall surface in the cylinder.

DESCRIPTION OF EMBODIMENTS

First Embodiment

Description of System Configuration

Figure 1:
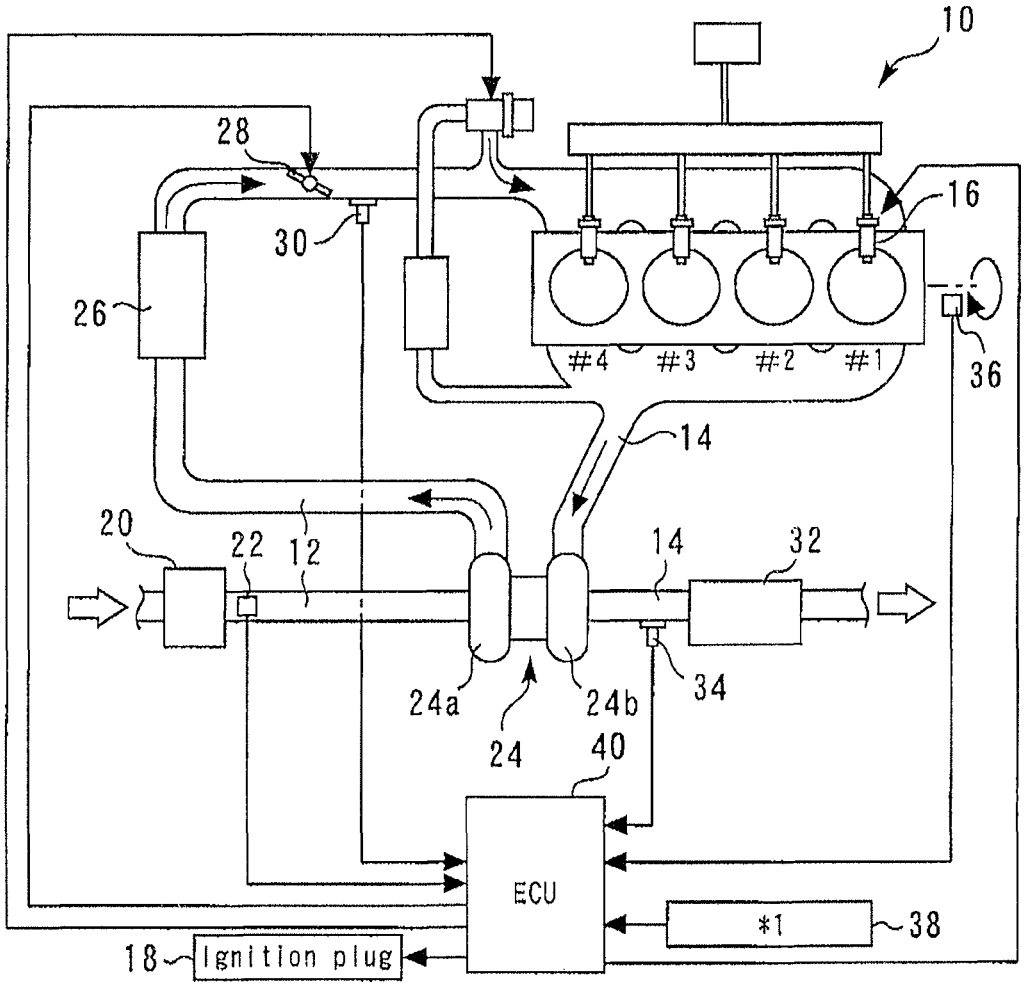
FIG. 1 is a diagram for explaining a system configuration of an internal combustion engine according to a first embodiment of the present invention.

FIG. 1 is a diagram for explaining a system configuration of an internal combustion engine 10 according to a first embodiment of the present invention. The system of the present embodiment includes a spark ignition type internal combustion engine (gasoline engine) 10. An intake passage 12 and an exhaust passage 14 are in communication with each cylinder of the internal combustion engine 10. In addition, each cylinder of the internal combustion engine 10 includes a fuel injection valve 16 for directly injecting fuel into a cylinder, and an ignition plug 18 for igniting a mixture gas.

An air cleaner 20 is installed at a position near an inlet of the intake passage 12. An air flow meter 22 is installed near a downstream position of the air cleaner 20. The air flow meter 22 outputs a signal according to a flow rate of air drawn into the intake passage 12. A compressor 24*a* of a turbo supercharger 24 is installed downstream of the air flow meter 22. The compressor 24*a* is integrally connected, via a coupling shaft, to a turbine 24*b* disposed at the exhaust passage 14.

An intercooler 26 that cools compressed air is installed downstream of the compressor 24*a*. An electronically controlled throttle valve 28 is installed downstream of the intercooler 26. An intake pressure sensor 30 for detecting a pressure in the intake passage is installed downstream of the throttle valve 28.

In addition, a catalyst 32 for purifying exhaust gas is disposed in the exhaust passage 14 on the downstream side of the turbine 24*b*. An air fuel ratio sensor 34 that issues an output generally linear with respect to the air fuel ratio of the exhaust gas flowing into the catalyst 32 is disposed upstream of the catalyst 32.

Furthermore, a crank angle sensor 36 for detecting an engine speed is installed in the vicinity of a crankshaft. A water temperature sensor 38 for detecting an engine cooling water temperature is installed in the internal combustion engine 10. The system shown in FIG. 1 further includes an ECU (Electronic Control Unit) 40. Various sensors for detecting the operational state of the internal combustion engine 10, such as the air flow meter 22, the intake pressure sensor 30, the air fuel ratio sensor 34, the crank angle sensor 36 and the water temperature sensor 38 that are described above, are connected to an input section of the ECU 40. In addition, various actuators for controlling the operational state of the internal combustion engine 10, such as the fuel injection valve 16, the ignition plug 18 and the throttle valve 28 that are described above, are connected to an output section of the ECU 40. The ECU 40 controls the operational state of the internal combustion engine 10 by driving the various actuators in accordance with predetermined programs and the outputs of the aforementioned various sensors.

In a low-speed and high-load region of the internal combustion engine 10 (mainly, a supercharging region), pre-ignition or heavy knock may occur when an ignition source, such as oil which exists in the cylinder (an ignition point of which is lower than that of mixture gas of gasoline), or deposits, self-ignites during the compression stroke or before the propagation of flame arrives after a spark ignition. The probability of occurrence of such abnormal combustion varies in accordance with the operational condition of the internal combustion engine 10. Specifically, if matter which becomes an ignition source such as oil or deposits is accumulated in the combustion chamber, the probability of occurrence of abnormal combustion increases. In addition, if the aforementioned matter accumulated in the intake system is introduced into the cylinder, the probability of occurrence of abnormal combustion also increases. Furthermore, if a fuel injected into the cylinder by the fuel injection valve 16 attaches to the wall surface of the cylinder, oil attached to the wall surface in the cylinder is diluted by the fuel. Such dilution of oil by fuel (so called, fuel dilution) decreases the surface tension of oil film on the wall surface in the cylinder and increases the probability of occurrence of liquid droplets that are suspended in the cylinder, and thereby, the probability of occurrence of abnormal combustion increases. Moreover, if the temperature of the cooling water of the internal combustion engine 10 is low, the degree of fuel dilution increases, and therefore, the probability of occurrence of abnormal combustion increases.

Characteristic Control in First Embodiment

In the present embodiment, a fuel dilution index is introduced that represents the degree of fuel dilution of oil attached to the wall surface in the cylinder. Specifically, the fuel dilution index is defined as a value obtained by subtracting from the exhaust air fuel ratio, the air fuel ratio of mixture gas (air amount/fuel injection amount) supplied into the cylinder, as follows.

Fuel dilution index=exhaust air fuel ratio−(air amount/fuel injection amount)

If, for example, the amount of fuel attached to the wall surface in the cylinder increases due to the decrease in the temperature of the cooling water, the degree of fuel dilution increases. As a result of this, the exhaust air fuel ratio becomes leaner (larger) than the air fuel ratio of the mixture gas supplied into the cylinder. Therefore, the condition of fuel dilution in the cylinder of the internal combustion engine 10 can be estimated on the basis of the magnitude of the fuel dilution index that is set as described above.

Figure 2:
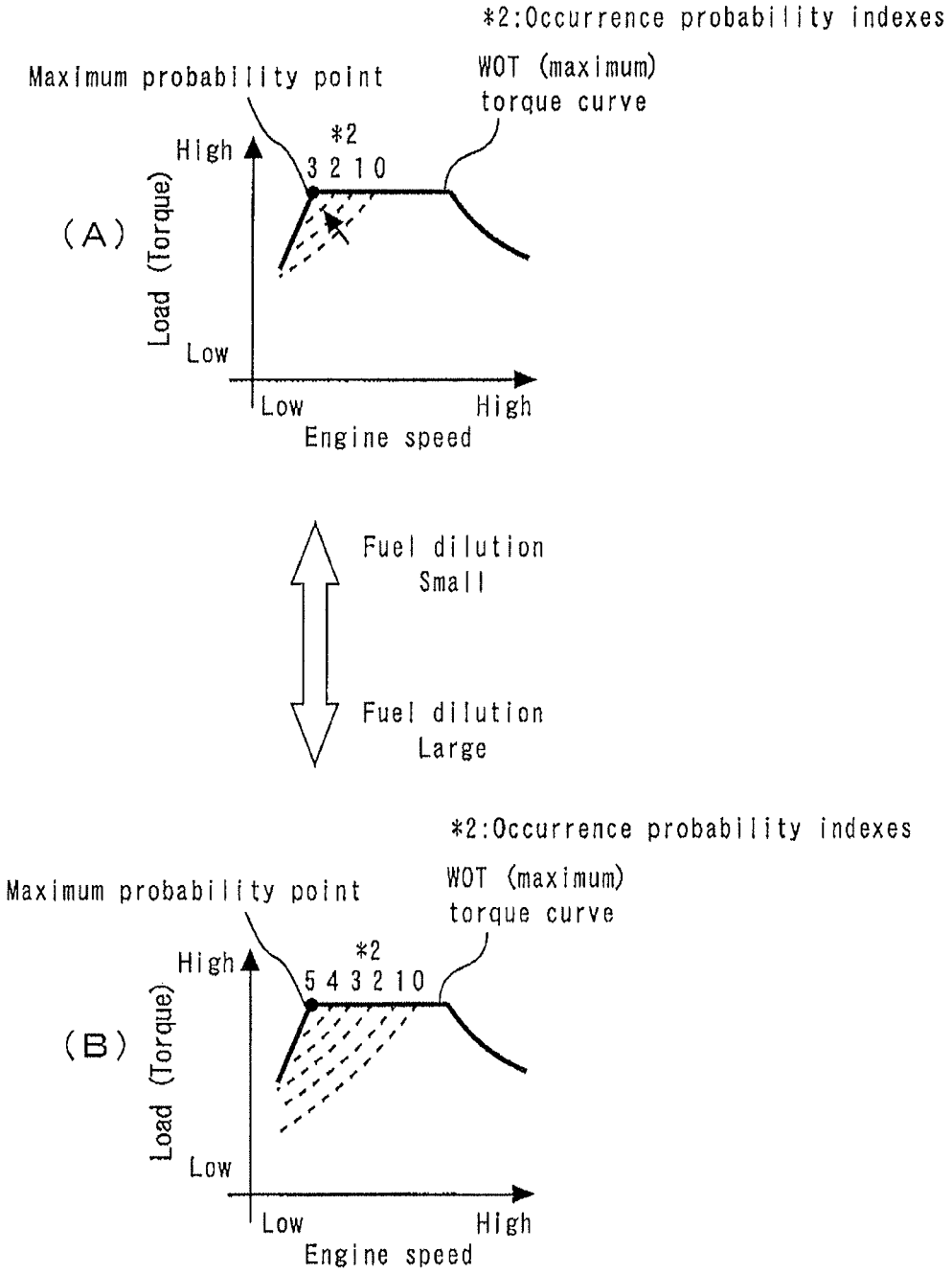
FIG. 2 is a diagram for explaining a setting of an occurrence probability map of abnormal combustion that is used for a control according to the first embodiment of the present invention.

FIG. 2 is a diagram for explaining a setting of an occurrence probability map of abnormal combustion that is used for the control according to the first embodiment of the present invention.

As shown in FIG. 2, in the present embodiment, a plurality of occurrence probability maps of abnormal combustion are included in the ECU 40 depending on the magnitude of the aforementioned fuel dilution index. These occurrence probability maps of abnormal combustion (hereinafter, simply abbreviated to the "occurrence probability map" in some cases) define occurrence probability indexes of abnormal combustion with a relation with the operational region (that is defined with a load (torque) and an engine speed) of the internal combustion engine 10. This occurrence probability index is an index that represents the occurrence probability of abnormal combustion, and assumed herein to be the frequency of occurrence of abnormal combustion per one hour as one example.

The curve shown by the solid line in FIG. 2 represents a torque curve (a curve obtained by joining maximum torque points at the respective engine speeds) of the internal combustion engine 10 at the time of full load (WOT (Wide Open Throttle)), and the curves shown by the broken line in FIG. 2 represent contour lines of the occurrence probability index of abnormal combustion that are obtained by joining operational points at which the occurrence probability indexes are equal. According to the occurrence probability map, the occurrence probability indexes are set so as to be larger with an increase in load in the low speed region, as shown in FIG. 2. FIG. 2(A) represents an occurrence probability map in a standard state in which the fuel dilution index is small, and FIG. 2(B) represents an occurrence probability map in a high probability state in which the occurrence probability of abnormal combustion is high due to the fact that the fuel dilution index is larger than that in the standard state. More specifically, according to the occurrence probability map shown in FIG. 2(B), an operational region in which abnormal combustion may occur extends to the lower load side, and the maximum value of the occurrence probability index on the higher load side becomes larger, as compared with the one shown in FIG. 2(A).

Figure 3:
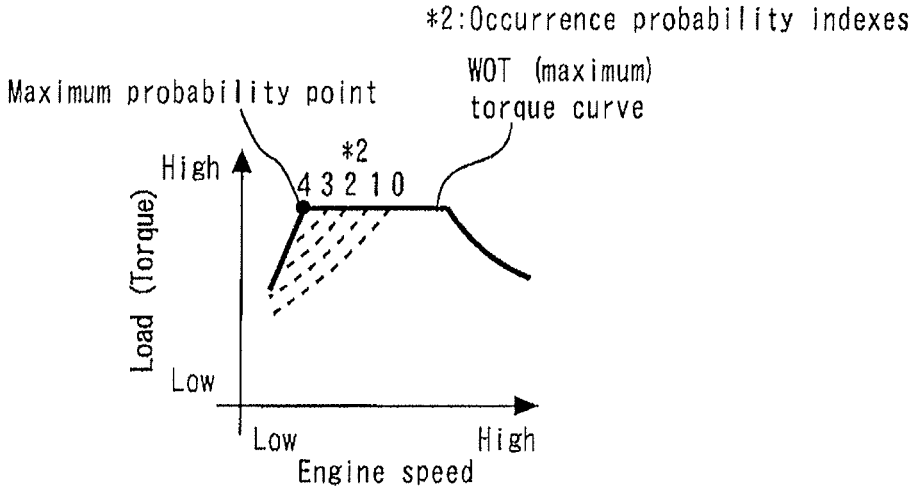
FIG. 3 is a diagram for showing an occurrence probability map of abnormal combustion in a tolerable state in which occurrence probability indexes of abnormal combustion are at a tolerable level.
Figure 4:
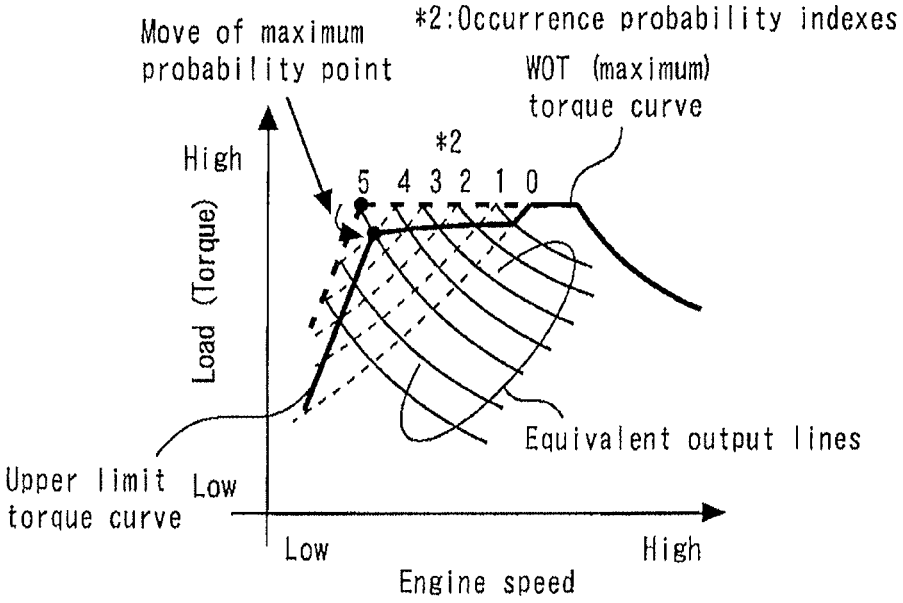
FIG. 4 is a diagram for explaining a characteristic control method to suppress an occurrence of abnormal combustion, according to the first embodiment of the present invention.

FIG. 3 is a diagram for showing an occurrence probability map of abnormal combustion in a tolerable state in which the occurrence probability indexes of abnormal combustion are at a tolerable level, and FIG. 4 is a diagram for explaining a characteristic control method to suppress an occurrence of abnormal combustion, according to the first embodiment of the present invention.

In the present embodiment using the occurrence probability map described so far, the following control is performed in a case in which the occurrence probability index at a maximum probability point at which the occurrence probability index reaches its maximum in the operational region is larger than a predetermined tolerable value (maximum value of the occurrence probability indexes in the tolerable state shown in FIG. 3) (for example, the high probability state shown in FIG. 2(B) corresponds to the case). More specifically, in this case, an upper limit value of the torque generated by the internal combustion engine 10 is limited low so that, on the equivalent output line of the internal combustion engine 10, the maximum probability point moves to a position at which the occurrence probability becomes equal to the aforementioned tolerable value as shown in FIG. 4.

More specifically, in the present embodiment, when the occurrence probability index at the maximum probability point is larger than the aforementioned tolerable value, the upper limit value of the torque is limited low so that a torque curve, in which the occurrence probability equivalent to that of the maximum torque curve in the tolerable state shown in FIG. 3 in which the occurrence probability is at a tolerable level is obtained on the equivalent output line, becomes an upper limit torque curve.

Figure 5:
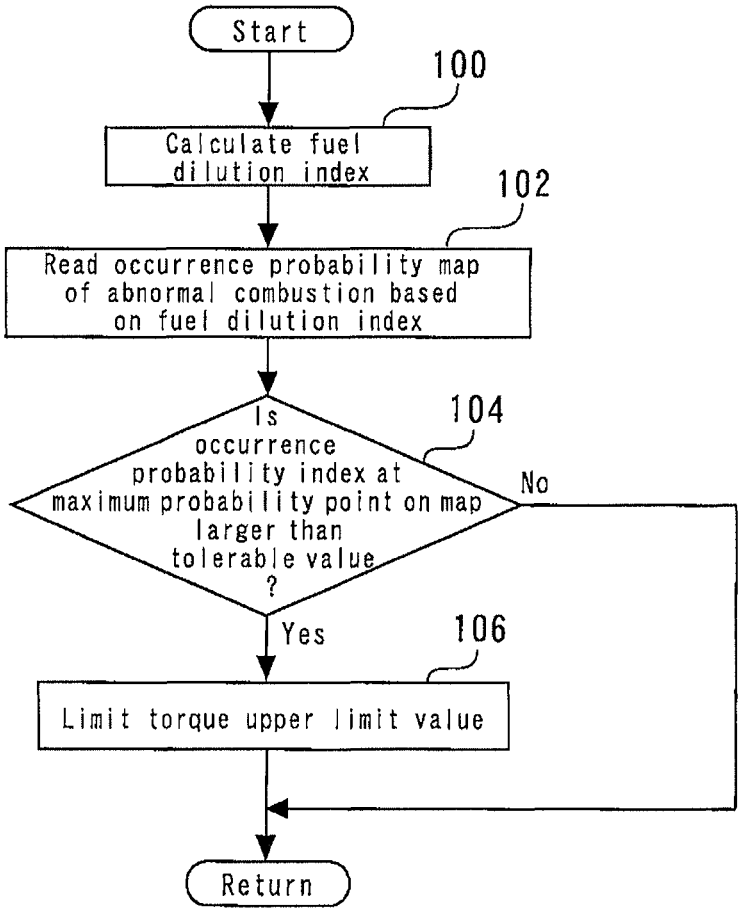
FIG. 5 is a flowchart of a routine that is executed in the first embodiment of the present invention.

FIG. 5 is a flowchart that represents a control routine executed by the ECU 40 in the present first embodiment to implement the above described control. The present routine is repeatedly executed at predetermined control intervals.

According to the routine shown in FIG. 5, first, the fuel dilution index is calculated that is defined as a value obtained by subtracting from the exhaust air fuel ratio the air fuel ratio (air amount/fuel injection amount) of mixture gas supplied into the cylinder, as described above (step 100). In this connection, a value calculated on the basis of the output of the air fuel ratio sensor 34 is used as the aforementioned exhaust air fuel ratio, a value calculated on the basis of the output of the air flow meter 22 or the intake pressure sensor 30 is used as the aforementioned air amount, and a value calculated on the basis of a fuel injection period by the fuel injection valve 16 and a fuel pressure is used as the aforementioned fuel injection amount.

Next, the occurrence probability map of abnormal combustion is read on the basis of the fuel dilution index calculated in aforementioned step 100 (step 102). As already described, a plurality of the occurrence probability maps are stored in advance in the ECU 40 depending on the magnitude of the fuel dilution index. According to present step 102, the occurrence probability map corresponding to the current fuel dilution index is obtained. It is then determined whether or not the occurrence probability index at the maximum probability point on the occurrence probability map read is larger than the maximum value (the aforementioned tolerable value) of the occurrence probability index on the occurrence probability map in the tolerable state (step 104).

If, as a result, the determination of aforementioned step 104 is positive, the upper limit value of the torque is limited low so that a torque curve, in which the occurrence probability equivalent to that of the maximum torque curve in the tolerable state is obtained on the equivalent output line, becomes an upper limit torque curve (step 106).

According to the routine shown in FIG. 5 described so far, when the occurrence probability index at the maximum probability point is larger than the aforementioned tolerable value, the upper limit value of the torque is limited low so that a torque curve, in which the occurrence probability equivalent to that of the maximum torque curve in the aforementioned tolerable state is obtained on the equivalent output line, becomes the upper limit torque curve. This allows the maximum probability point to move, on the equivalent output line, to a position at which the occurrence probability is equal to the aforementioned tolerable value, as shown in FIG. 4. More specifically, the limit of the upper limit value of the torque is performed by limiting the intake air mount by use of adjustment of the opening degree of the throttle valve 28.

As a result of performing the aforementioned control, the use of the operational region, which exceeds the upper limit torque curve and is on the lower speed and higher load side is limited in order to decrease the occurrence probability of abnormal combustion, as shown in FIG. 4. This allows the occurrence probability of abnormal combustion to be decreased to the same level as that in the aforementioned tolerable state, under a situation in which the occurrence probability of abnormal combustion becomes high due to the fact that the fuel dilution index is large. Therefore, an occurrence of abnormal combustion can be successfully suppressed regardless of any operational conditions.

In addition, according to the aforementioned routine, a torque curve, in which the occurrence probability equivalent to that of the maximum torque curve in the aforementioned tolerable state is obtained on the equivalent output line, is used as the upper limit torque curve, and thereby, the occurrence probability of abnormal combustion can be decreased to the same level as that in the aforementioned tolerable state, with the internal combustion engine 10 being able to produce the equivalent output power.

Incidentally, in the first embodiment, which has been described above, description has been made regarding a case in which one maximum probability point at which the occurrence probability of abnormal combustion reaches its maximum is present, as shown in FIGS. 2 to 4. However, the number of the maximum probability points on the operational region of the prevent invention is not limited to only one. More specifically, the present invention is also addressed to a case in which a plurality of the maximum probability points are present on the operational region.

In addition, in the first embodiment, which has been described above, the upper limit value of the torque is limited low so that the maximum probability point moves, on the equivalent output line, to a position at which the occurrence probability is equal to the aforementioned tolerable value. However, the present invention is not limited to this, and the upper limit value of the torque may be limited low so that the maximum probability point moves, on the equivalent output line, to a position at which the occurrence probability is lower than the aforementioned tolerable value.

It is noted that in the first embodiment, which has been described above, the ECU 40 executes the aforementioned processing of step 102, whereby the "abnormal combustion probability obtaining means" according to the fourth aspect of the present invention is realized, and the ECU 40 executes the aforementioned processing of steps 104 and 106, whereby the "torque limit means" according to the fourth aspect of the present invention is realized.

In addition, in the first embodiment, which has been described above, the ECU 40 executes the aforementioned processing of step 100, whereby the "fuel dilution index obtaining means" according to the seventh aspect of the present invention is realized.

Second Embodiment

Next, a second embodiment of the present invention will be described with reference to FIGS. 6 to 8.

The system of the present embodiment can be implemented by using the hardware configuration shown in FIG. 1 and causing the ECU 40 to execute the routine shown in FIG. 8 described below, instead of the routine shown in FIG. 5.

According to the control method of the present first embodiment described above, under a situation in which the occurrence probability of abnormal combustion is high, the torque at low speed always decreases due to the fact that the use of the operational region on the lower speed and higher load side is limited. As a result of this, the drivability of the internal combustion engine 10 may be deteriorated. In fact, even in the high probability state in which the occurrence probability of abnormal combustion is high (for example, FIG. 2(B)), it is unlikely that abnormal combustion will actually occur, provided that a time period during which an operational region that is with a large occurrence probability index and on the lower speed and higher load side is used is short. In contrast, even when in the low probability state in which the occurrence probability of abnormal combustion has not increased (for example, the standard state shown in FIG. 2(A)), it is likely that abnormal combustion will actually occur, provided that a time period during which an operational region that is with a large occurrence probability index and on the lower speed and higher load side is used is long.

Characteristic Control in Second Embodiment

Accordingly, in the present embodiment, an index described hereinafter is introduced as an index using when limiting the operational region in order to suppress an occurrence of abnormal combustion.

A numerical value of the occurrence probability index shown in FIG. 2(B) is herein assumed to be treated as the number of occurrences of abnormal combustion per hour. By doing so, an expected value I (60 min.) of the number of occurrences of abnormal combustion when the internal combustion engine 10 is operated on the contour line of the occurrence probability index 2 in FIG. 2(B) over one hour can be expressed as follows, by use of the occurrence probability p (N, T) of abnormal combustion in each operational region of the internal combustion engine 10, which is defined by the engine speed N and the load (torque) T.

$$I(60\ \text{min.}) = \int_0^{60\ min.} p(N(t), T(t))\,dt = 2$$

Figure 6:
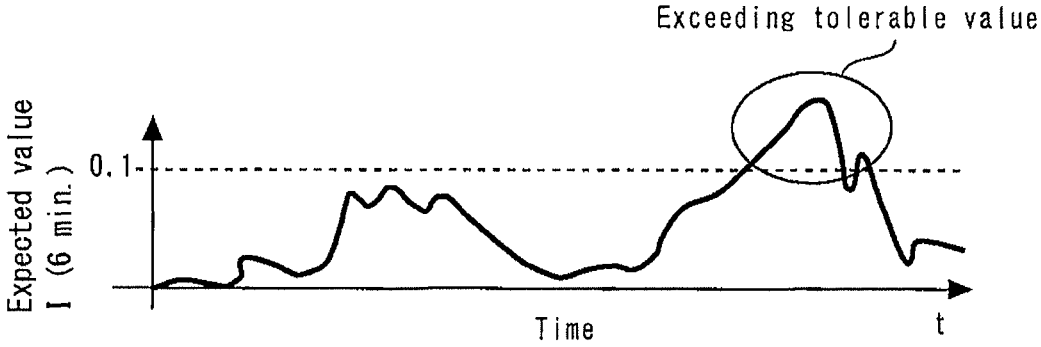
FIG. 6 is a diagram showing one example of the appearance of a change in an expected value I (6 min.) of the number of occurrences of abnormal combustion.

FIG. 6 is a diagram showing one example of the appearance of a change in the expected value I (6 min.) of the number of occurrences of abnormal combustion.

It is herein assumed that the tolerable value of the number of occurrences of abnormal combustion per 60 minutes is one. By doing so, the expected value becomes 0.1 per 6 minutes. In addition, the expected value I (6 min.) of the number of occurrences of abnormal combustion per 6 minutes can be expressed as follows, by integrating the occurrence probability p (N, T) of abnormal combustion over the past 6 minutes during operation of the internal combustion engine 10.

$$I(6\ \text{min.}) = \int_{-6\ \text{min.}}^{0} p(N(t), T(t))\,dt$$

As described above, the expected value I (6 min.) is a value of integral of the occurrence probability p (N, T) of abnormal combustion over the past 6 minutes during the operation and therefore, fluctuates as shown in FIG. 6 in accordance with the operation record of the internal combustion engine 10 over the past 6 minutes (the operational regions used during that time). For example, the expected value I (6 min.) increases if the low speed and high load region is used long. Then, if this expected value I (6 min.) exceeds the tolerable value, 0.1, the number of occurrences of abnormal combustion per 60 minutes becomes larger than one, which is the tolerable value.

Accordingly, in the present embodiment, in order to suppress an occurrence of abnormal combustion, the upper limit value of the torque that is generated by the internal combustion engine 10 is limited low so that the expected value I (herein, I (6 min.)) of the number of occurrences of abnormal combustion per a predetermined time period (herein, 6 minutes) does not exceed a predetermined tolerable value (herein, 0.1).

Figure 7:
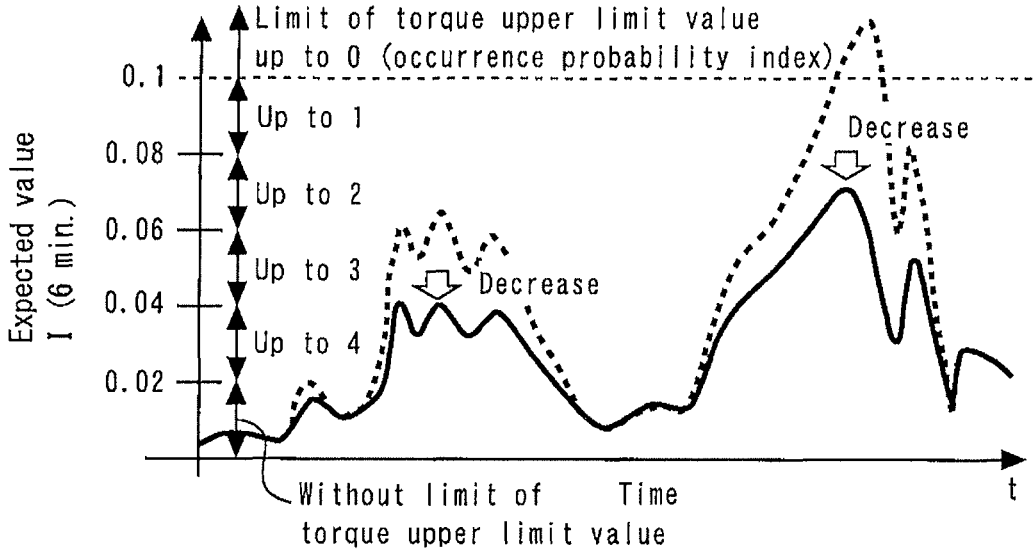
FIG. 7 is a diagram for explaining a characteristic control method to suppress an occurrence of abnormal combustion, according to a second embodiment of the present invention.

FIG. 7 is a diagram for explaining a characteristic control method to suppress an occurrence of abnormal combustion, according to the second embodiment of the present invention.

The operation record represented by FIG. 7 is an operation record in the high probability state shown in FIG. 2(B) (a state where the maximum value of the occurrence probability index is 5), which is reached due to the fact that the fuel dilution index is large. According to the present embodiment, the tolerable value (here, 0.1) of the number of occurrences of abnormal combustion in this case is equally divided by 5 (the number of contour lines in FIG. 2(B)), which is the maximum value of the occurrence probability index of abnormal combustion corresponding to the current fuel dilution index.

On that basis, the upper limit value of the torque is limited lower, every time the expected value I (6 min.) exceeds a value at each point of division obtained by equally dividing into 5. More specifically, as shown in FIG. 7, the upper limit value of the torque is limited lower so as not to, as the value at the point of division which the expected value I (6 min.) exceeds is larger, exceed a contour line the occurrence probability index of which is smaller (that is to say, the operational region on the lower speed and higher load side is limited more widely).

Figure 8:
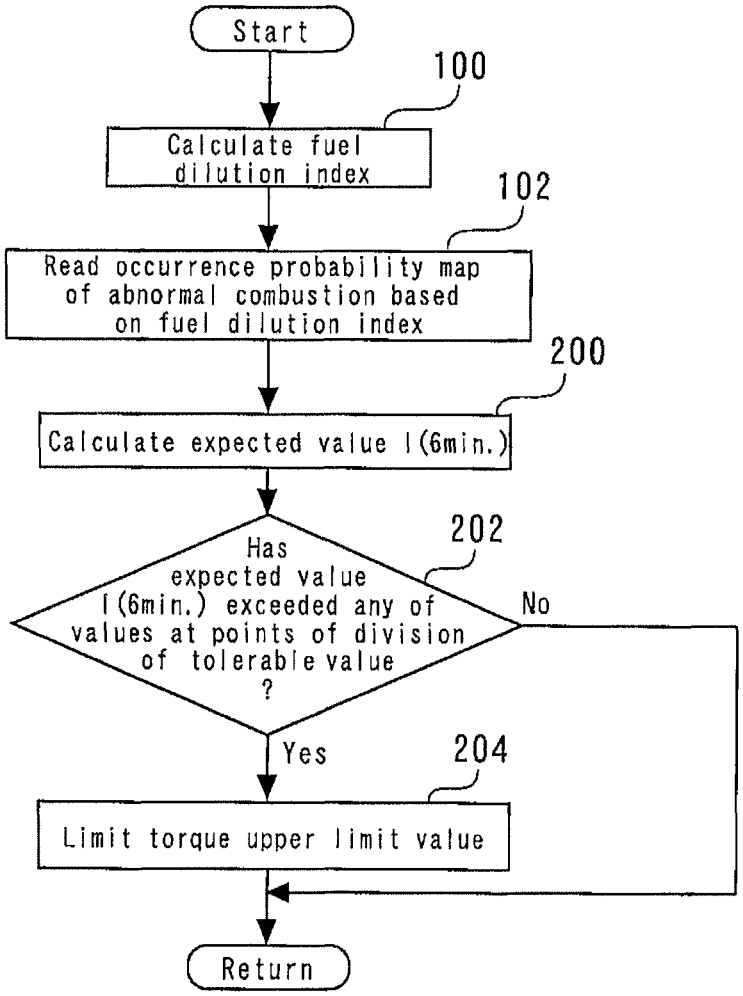
FIG. 8 is a flowchart of a routine that is executed in the second embodiment of the present invention.

FIG. 8 is a flowchart that represents a control routine executed by the ECU 40 in the present second embodiment to implement the above described control. In FIG. 8, the same steps as the steps shown in FIG. 5 in the first embodiment will be assigned with the same reference numerals, and the description thereof will be omitted or simplified.

According to the routine shown in FIG. 8, after the occurrence probability map of abnormal combustion depending on the fuel dilution index is read in step 102, the expected value I (6 min.) of the number of occurrences of abnormal combustion is calculated (step 200). More specifically, the expected value I (6 min.) of the number of occurrences of abnormal combustion is calculated in accordance with the above mentioned relational expression, by use of the occurrence probability p (N, T) of abnormal combustion obtained by referring to the occurrence probability map of abnormal combustion which is read.

Next, it is determined whether or not the expected value I (6 min.) calculated in aforementioned step 200 has exceeded any of the values at the points of division of the tolerable value (step 202). As already described, the value at each point of division is a value obtained by equally dividing the tolerable value (here, 0.1) of the number of occurrences of abnormal combustion into the maximum value (5 in the case of the occurrence probability map in FIG. 2(B)) of the occurrence probability index in the occurrence probability map of abnormal combustion which is read in aforementioned step 102. For example, in the case of the occurrence probability map in FIG. 2(B), five values of 0.02 to 0.1 (see FIG. 7) correspond to the values of the points of division because the maximum value of the occurrence probability index is 5. In this way, the number of division of the tolerable value concerning the number of occurrences of abnormal combustion is changed in accordance with the maximum value of the occurrence probability index on the occurrence probability map of abnormal combustion which is read depending on the fuel dilution index.

If the determination of aforementioned step 202 is positive, the upper limit value of the torque generated by the internal combustion engine 10 is limited low in accordance with the magnitude of the value of the point of division which the expected value I (6 min.) has exceeded (step 204). Specifically, there is stored in ECU 40, a relation between values of the respective points of division and occurrence probability indexes on the occurrence probability map of abnormal combustion corresponding thereto, for each of occurrence probability maps of abnormal combustion that differ in the maximum value of the occurrence probability index. Further, the relation between these values of points of division and the occurrence probability indexes is stored so that, as the value of the point of division becomes larger, the corresponding occurrence probability index of abnormal combustion becomes smaller. According to present step 204, the limit of the upper limit value of the torque is performed in such a way as to prohibit the use of the operational region on the lower speed and higher load side so as not to exceed the contour line of the occurrence probability index corresponding to the value of the point of division which the expected value I (6 min.) has currently exceeded.

The waveform shown by the broken line in FIG. 7 is the one in a case in which the control of the routine shown in FIG. 8 described so far is not executed. On the other hand, by executing the control shown in the aforementioned routine, the limit of the upper limit value of the torque (the limit of the operational region on the lower speed and higher load side) is performed every time the expected value I (6 min.) exceeds the value of each point of division, and therefore, the expected value I (6 min.) can be decreased so as not to exceed the tolerable value as the waveform shown by the solid line in FIG. 7. This makes it possible to successfully suppress an occurrence of abnormal combustion regardless of the operational conditions.

In addition, according to the control method of the present embodiment, the limit of the upper limit value of the torque is not performed until the expected value I (6 min.) exceeds the value of the first point of division, and as a result, the limit of use of the operational region on the lower speed and higher load side is not performed. That is to say, the use of such operational region on the lower speed and higher load side is available, if time is short. Furthermore, even after the expected value I (6 min.) has exceeded the value of the first point of division, the operational region on the lower speed and higher load side is gradually limited with a method by which, as the value of the point of division that the expected value I (6 min.) exceeds becomes larger, the upper limit value of the torque is limited lower. That is to say, according to the method of the present embodiment, the upper limit value of the torque is limited lower as the expected value I (6 min.) becomes larger toward the tolerable value.

As described above, in the present embodiment, an index, the expected value I of the number of occurrences of abnormal combustion is introduced, and the limit of the operational region on the lower speed and higher load side is performed so that this expected value I does not exceed the tolerable value. Therefore, an occurrence of abnormal combustion can be suppressed, while the limit of a usable operational region is avoided from being provided as possible by taking into consideration the time of use of the low speed and high load region. This makes it possible to suppress an occurrence of abnormal combustion, while suppressing the deterioration of the drivability of the internal combustion engine 10 as possible.

It is noted that in the second embodiment, which has been described above, the ECU 40 executes the aforementioned processing of step 102, whereby the "abnormal combustion probability obtaining means" according to the first aspect of the present invention is realized, the ECU 40 executes the aforementioned processing of step 200, whereby the "expected-value calculation means" according to the first aspect of the present invention is realized, and the ECU 40 executes the aforementioned processing of steps 202 and 204, whereby the "torque limit means" according to the first aspect of the present invention is realized.

In addition, in the second embodiment, which has been described above, the ECU 40 executes the aforementioned processing of step 100, whereby the "fuel dilution index obtaining means" according to the seventh aspect of the present invention is realized.

Incidentally, in the first and second embodiments, which have been described above, the occurrence probability of abnormal combustion is obtained on the basis of the fuel dilution index. However, the obtaining method of the occurrence probability of abnormal combustion in the present invention is not limited to the aforementioned method.

DESCRIPTION OF SYMBOLS

10 internal combustion engine
12 intake passage
14 exhaust passage
16 fuel injection valve
18 ignition plug
22 air flow meter
24 turbo supercharger
24*a* compressor
24*b* turbine
28 throttle valve
30 intake pressure sensor
32 catalyst
34 air fuel ratio sensor
36 crank angle sensor
38 water temperature sensor
40 ECU (Electronic Control Unit)

The invention claimed is:

1. A control apparatus for an internal combustion engine, comprising a controller that is configured to:

obtain an occurrence probability of abnormal combustion of an internal combustion engine;

calculate an expected value of the number of occurrences of the abnormal combustion per a predetermined time period, based on the occurrence probability of the abnormal combustion; and cause an upper limit value of a torque generated by the internal combustion engine to be lowered so that the expected value does not exceed a predetermined tolerable value.

2. The control apparatus for an internal combustion engine according to claim 1, wherein the controller causes the upper limit value of the torque to be lowered more, as the expected value becomes larger toward the tolerable value.

3. The control apparatus for an internal combustion engine according to claim 2, wherein the controller causes the upper limit value of the torque to be lowered more, as a value which is at a point of division of the tolerable value and which the expected value exceeds increases.

4. The control apparatus for an internal combustion engine according to claim 1, wherein the controller obtains a fuel dilution index that represents a degree of fuel dilution of oil attached to a wall surface in a cylinder of the internal combustion engine, and obtains the occurrence probability based on the fuel dilution index.

5. A control apparatus for an internal combustion engine, comprising a controller that is configured to:

obtain an occurrence probability of abnormal combustion of an internal combustion engine in relation to an operational region of the internal combustion engine; and cause an upper limit value of a torque generated by the internal combustion engine to be lowered so that a maximum probability point at which the occurrence probability reaches its maximum in the operational region moves to a position at which the occurrence probability becomes smaller or equal to a predetermined tolerable value, wherein the controller obtains a fuel dilution index that represents a degree of fuel dilution of oil attached to a wall surface in a cylinder of the internal combustion engine, and obtains the occurrence probability based on the fuel dilution index.

6. The control apparatus for an internal combustion engine according to claim 5, wherein when the occurrence probability at the maximum probability point is higher than the expected value, the controller causes the upper limit value of the torque to be lowered so that, on an equivalent output line of the internal combustion engine, the maximum probability point moves to a position at which the occurrence probability becomes equal to or lower than the expected value.

7. The control apparatus for an internal combustion engine according to claim 5, wherein when the occurrence probability at the maximum probability point is higher than the expected value, the controller causes the upper limit value of the torque to be lowered so that a torque curve, in which the occurrence probability equivalent to that of a maximum torque curve in a tolerable state in which the occurrence probability is at a tolerable level is obtained on an equivalent output line of the internal combustion engine, becomes an upper limit torque curve.

8. A control apparatus for an internal combustion engine, comprising:

abnormal combustion probability obtaining means for obtaining an occurrence probability of abnormal combustion of an internal combustion engine;

expected-value calculation means for calculating an expected value of the number of occurrences of the abnormal combustion per a predetermined time period, based on the occurrence probability of the abnormal combustion that is obtained by the abnormal combustion probability obtaining means; and torque limit means for causing an upper limit value of a torque generated by the internal combustion engine to be lowered so that the expected value that is calculated by the expected-value calculation means does not exceed a predetermined tolerable value.

9. A control apparatus for an internal combustion engine, comprising:

abnormal combustion probability obtaining means for obtaining an occurrence probability of abnormal combustion of an internal combustion engine in relation to an operational region of the internal combustion engine; and torque limit means for causing an upper limit value of a torque generated by the internal combustion engine to be lowered so that a maximum probability point at which the occurrence probability reaches its maximum in the operational region moves to a position at which the occurrence probability becomes smaller or equal to a predetermined tolerable value, wherein the abnormal combustion probability obtaining means includes fuel dilution index obtaining means for obtaining a fuel dilution index that represents a degree of fuel dilution of oil attached to a wall surface in a cylinder of the internal combustion engine, and is means for obtaining the occurrence probability based on the fuel dilution index obtained by the fuel dilution index obtaining means.

* * * * *